US011655785B2

(12) United States Patent
Kuroda et al.

(10) Patent No.: US 11,655,785 B2
(45) Date of Patent: May 23, 2023

(54) ENGINE, OUTBOARD MOTOR AND BOAT

(71) Applicant: Honda Motor Co., Ltd., Tokyo (JP)

(72) Inventors: Tatsuya Kuroda, Wako (JP); Takanori Sato, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/676,193

(22) Filed: Feb. 20, 2022

(65) Prior Publication Data

US 2022/0282691 A1 Sep. 8, 2022

(30) Foreign Application Priority Data

Mar. 2, 2021 (JP) ..... JP2021-032849

(51) Int. Cl.
*F02M 35/10* (2006.01)
*F02M 35/16* (2006.01)

(52) U.S. Cl.
CPC .... *F02M 35/1038* (2013.01); *F02M 35/1015* (2013.01); *F02M 35/10222* (2013.01); *F02M 35/167* (2013.01)

(58) Field of Classification Search
CPC ..... F02M 35/10373; F02M 35/1038; F02M 35/1015; F02M 35/10222; F02M 35/167; F02M 35/116; F02B 75/007; F02B 61/045; F01B 1/04
See application file for complete search history.

(56) References Cited

U.S. PATENT DOCUMENTS 5,683,277 A * 11/1997 Tsunoda ..... B63H 21/38 123/195 P
8,596,113 B2 * 12/2013 Matsumoto ..... G01K 7/42 73/114.31
9,845,782 B1 * 12/2017 Bernier ..... F02B 75/04
2002/0115357 A1 * 8/2002 Hiki ..... B63H 21/213 440/1
2004/0069271 A1 * 4/2004 Kanno ..... F02D 41/221 123/399
2013/0115831 A1 * 5/2013 Harada ..... F02M 35/10321 440/88 A
2018/0023492 A1 * 1/2018 Tanigawa ..... F02B 75/20 123/305
2019/0162109 A1 * 5/2019 Romana ..... F02B 29/0418
2020/0198746 A1 * 6/2020 Nakayama ..... B63H 20/001

FOREIGN PATENT DOCUMENTS

JP 2006062413 A 3/2006

* cited by examiner

*Primary Examiner* — Grant Moubry
*Assistant Examiner* — James G Moubry
(74) *Attorney, Agent, or Firm* — Duft & Bornsen, PC

(57) ABSTRACT

A V-type multi-cylinder engine including a pair of banks, includes: an intake member forming an intake passage through which air is guided from outside; a pair of throttles each configured to regulate an amount of the air sucked into each of the pair of banks through the intake passage; and one single temperature sensor configured to detect a temperature of the air in the intake passage. The intake member includes a pair of openings downstream in a flowing direction of the air. Each the pair of throttles is connected to each of the pair of openings. The temperature sensor is disposed between the pair of openings.

8 Claims, 8 Drawing Sheets

ENGINE, OUTBOARD MOTOR AND BOAT

CROSS-REFERENCE TO RELATED APPLICATION

This application is based upon and claims the benefit of priority from Japanese Patent Application No. 2021-032849 filed on Mar. 2, 2021, the content of which is incorporated herein by reference.

BACKGROUND OF THE INVENTION

Field of the Invention

This invention relates to an engine, an outboard motor, and a boat.

Description of the Related Art

Conventionally, there has been known a device that has two throttle bodies and adjusts an amount of intake air sucked in by an air inlet port of each bank arranged in a V-type by using these two throttle bodies (e.g., see JP2006-062413A).

In the case of a device having two throttle bodies such as the device described in JP2006-062413A, when only the temperature of air flowing into one throttle body is detected, an error may occur between the actual intake air temperature guided to each bank and the detected intake air temperature.

SUMMARY OF THE INVENTION

An aspect of the present invention is a V-type multi-cylinder engine including a pair of banks. The engine includes: an intake member forming an intake passage through which air is guided from outside; a pair of throttles each configured to regulate an amount of the air sucked into each of the pair of banks through the intake passage; and one single temperature sensor configured to detect a temperature of the air in the intake passage. The intake member includes a pair of openings downstream in a flowing direction of the air. Each the pair of throttles is connected to each of the pair of openings. The temperature sensor is disposed between the pair of openings.

Another aspect of the present invention is an outboard motor, including: the engine; and a propeller driven by the engine to rotate.

Another aspect of the present invention is a boat, including: the outboard motor; and a hull mounted with the outboard motor.

BRIEF DESCRIPTION OF THE DRAWINGS

The objects, features, and advantages of the present invention will become clearer from the following description of embodiments in relation to the attached drawings, in which.

DETAILED DESCRIPTION OF THE INVENTION

Figure 1:
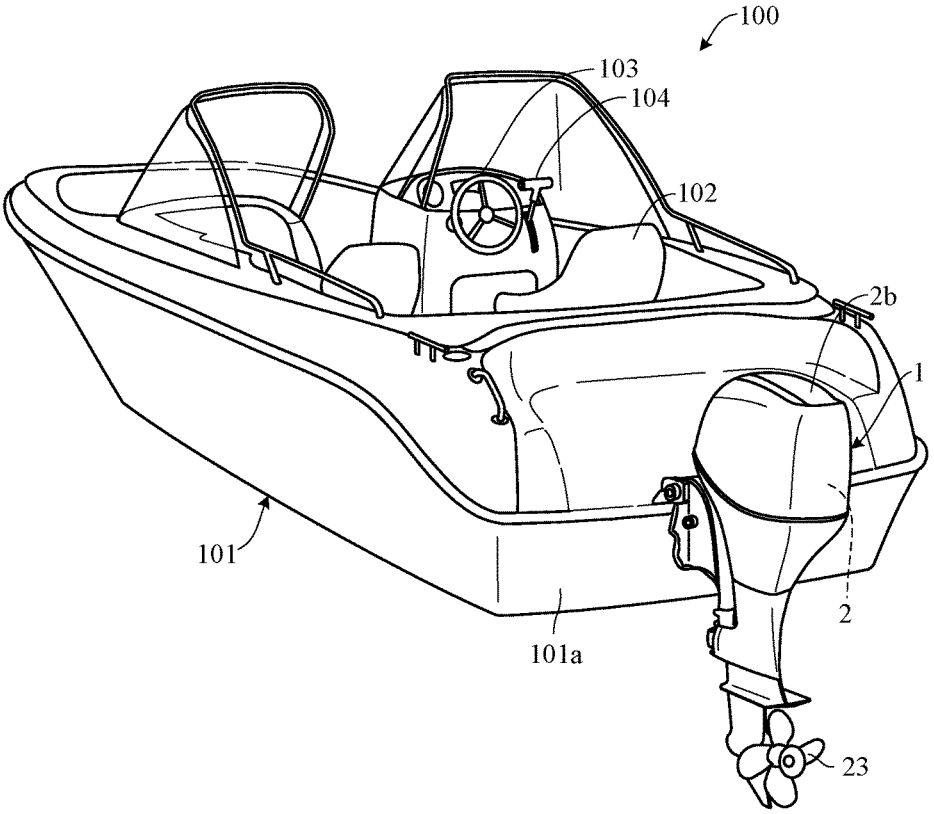
FIG. 1 is an external perspective view of a boat on which an outboard motor according to an embodiment of the present invention is mounted.

An embodiment of the present invention will be described below with reference to FIGS. 1 to 8. FIG. 1 is an external perspective view of a boat 100 on which an outboard motor 1 according to the present embodiment is mounted. Note that, hereinafter, for convenience, the front-back direction (propulsion direction), the left-right direction, and the up-down direction are defined as illustrated in the drawing, and each unit will be described according to this definition.

As illustrated in FIG. 1, the boat 100 includes a hull 101 and the outboard motor 1 attached to the stern of the hull 101, and is configured such that the hull 101 is propelled by power of the outboard motor 1 driven in response with an operation of a boat operator. In front of a cockpit 102 of the hull 101, a steering wheel 103 that can be rotated by the operator and a shift lever (shift/throttle lever) 104 that can be shifted by the operator are provided. A shift lever 104 is configured to be capable of shift operation in the forward direction or the backward direction from the neutral position, and inputs a switching instruction from the neutral position to the forward or backward direction and an adjustment instruction of the engine rotation speed in response to the operation of the boat operator.

Figure 2:
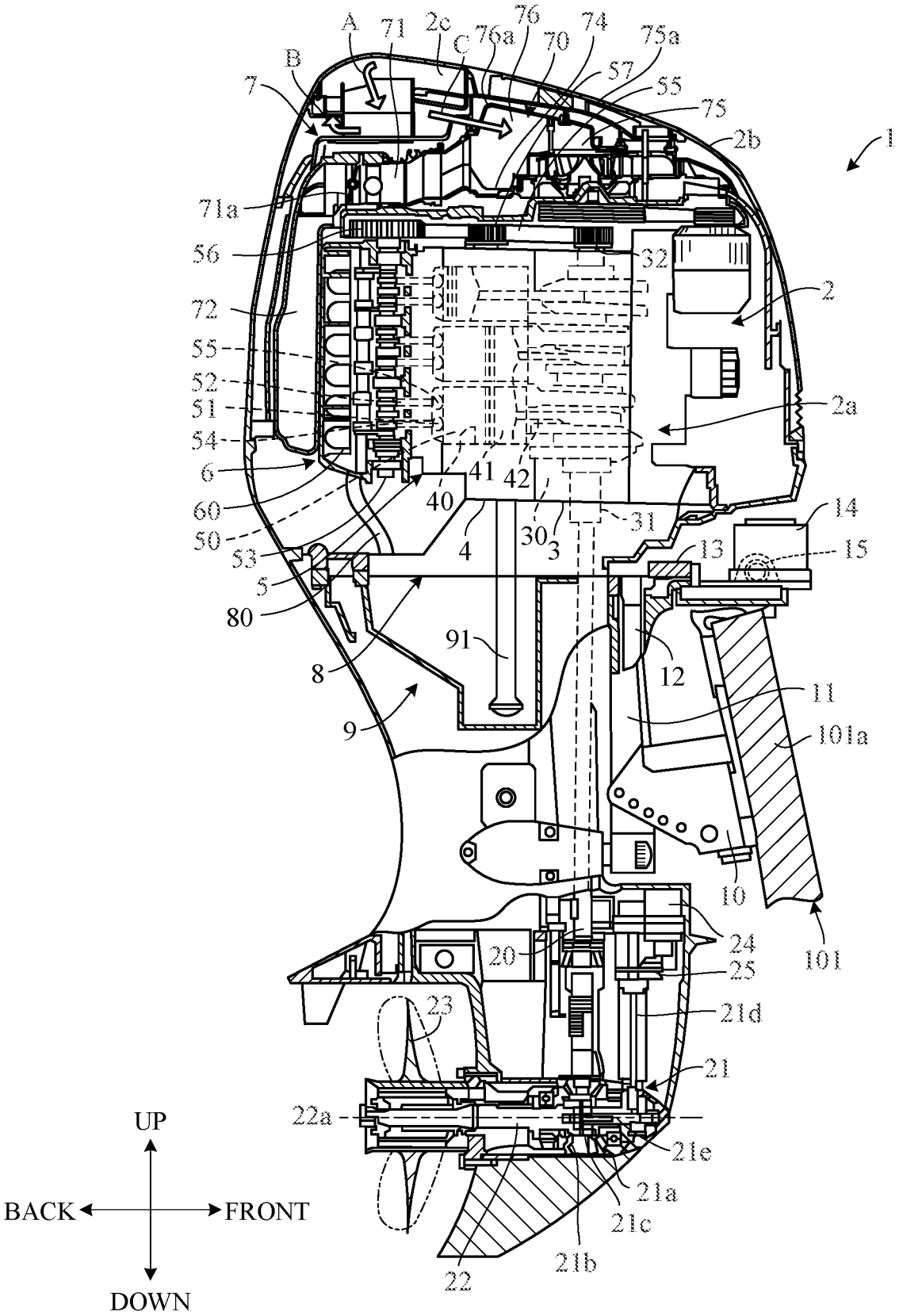
FIG. 2 is a longitudinal cross-sectional view illustrating a configuration of a main component of the outboard motor according to the embodiment of the present invention with a part of an engine cover cut away.

FIG. 2 is a longitudinal cross-sectional view illustrating the configuration of a main component of the outboard motor 1 with a part of an engine cover 2*b* cut away. As illustrated in FIG. 2, the outboard motor 1 is attached to a transom board 101*a* located at the stern of the hull 101 via a stern bracket 10 provided in front. A swivel case 11 is provided behind the stern bracket 10, and a swivel shaft 12 rotatable about a vertical axis is housed in the swivel case 11. The swivel shaft 12 is connected to a steering electric motor 14 via a reduction gear mechanism (not illustrated) and a mount frame 13, and constitutes a steering shaft that steers the hull 101 to the right and left in response to the rotation of the steering electric motor 14.

Power tilt units (not illustrated) for tilting up and down or trimming up and down the outboard motor 1 are provided on both right and left sides of the stern bracket 10. The power tilting unit includes a tilt angle adjustment hydraulic cylinder and a trim angle adjustment hydraulic cylinder, and the swivel case 11 rotates with a tilting shaft 15 as a rotation axis by extending and contracting these hydraulic cylinders. This causes the outboard motor 1 to be tilted up and down or trimmed up and down.

An engine 2 described later is mounted on an upper portion of the outboard motor 1, and the engine 2 is covered with an engine cover 2*b*. A crankshaft 31 of the engine 2 extends in the vertical direction, and the lower end of the crankshaft 31 is connected to the upper end of a drive shaft 20 extending in the vertical direction. The lower end of the drive shaft 20 is connected to one end of a propeller shaft 22 extending in the horizontal direction via a shift mechanism 21, and a propeller 23 is attached to the other end of the propeller shaft 22. The propeller shaft 22 is disposed such that an axis 22*a* becomes substantially parallel to the water surface when the trim angle is in a state of the initial angle.

The shift mechanism 21 includes a forward bevel gear 21*a* and a backward bevel gear 21*b* that are connected to the drive shaft 20 and rotate, a clutch 21*c* that engages the propeller shaft 22 with either the forward bevel gear 21*a* or the backward bevel gear 21*b*, a shift rod 21*d*, and a shift slider 21*e*. An output shaft of a shift electric motor 24 that performs a shift change by operating the shift mechanism 21 is connected to the upper end of the shift rod 21*d* via a reduction gear mechanism 25, and the shift slider 21*e* is connected to the lower end of the shift rod 21*d*.

When the shift electric motor 24 is driven in response to the operation of the shift lever 104 by the boat operator, the shift rod 21*d* and the shift slider 21*e* are appropriately displaced to operate the clutch 21*c*, and the shift mechanism 21 is switched between neutral, forward, and backward. When the shift mechanism 21 is forward or backward, the rotation of the drive shaft 20 is transmitted to the propeller shaft 22 via the shift mechanism 21, the propeller 23 rotates, and the hull 101 is propelled in the forward direction or the backward direction.

Figure 3:
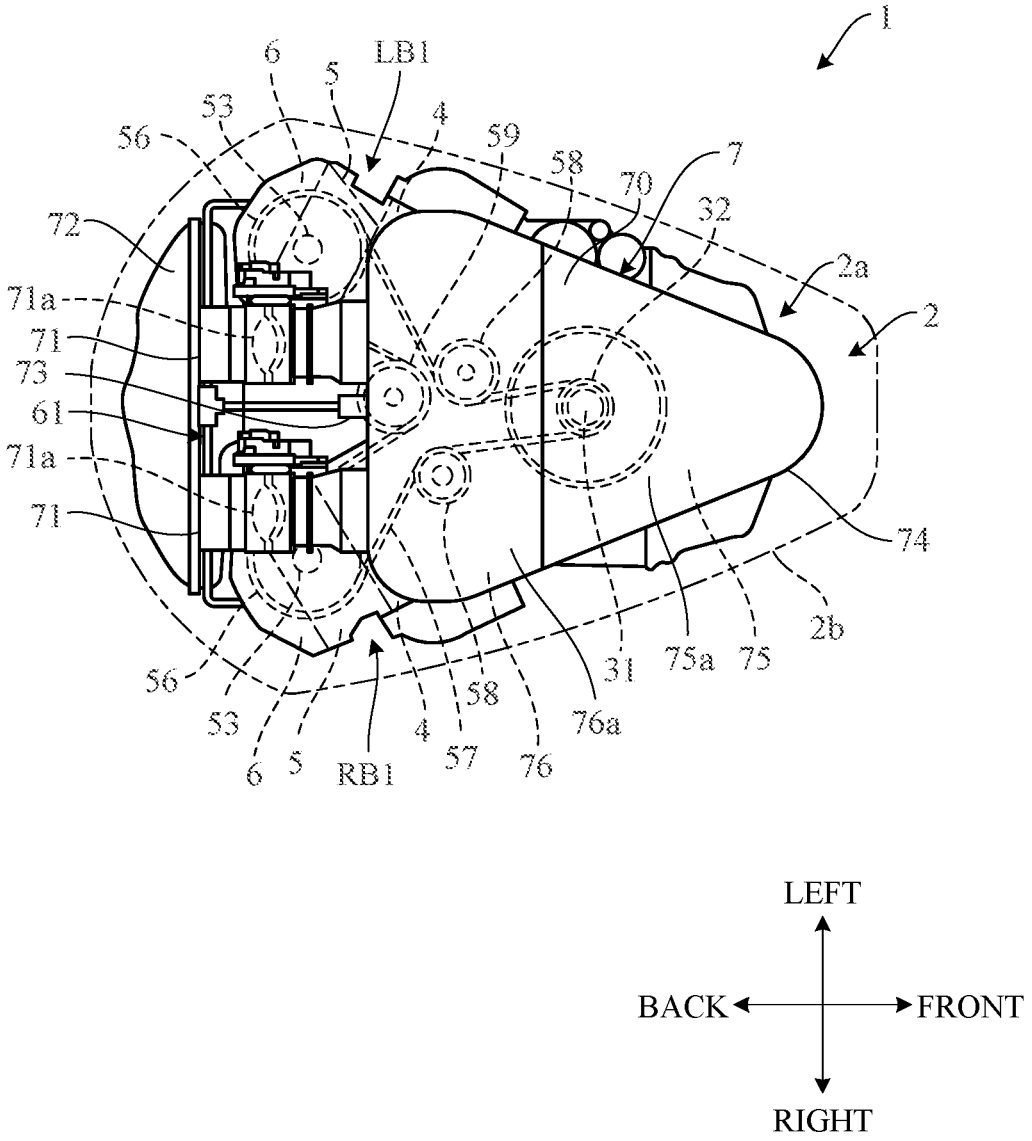
FIG. 3 is a plan view of an engine included in the outboard motor according to the embodiment of the present invention.

FIG. 3 is a plan view of the engine 2. As illustrated in FIGS. 2 and 3, the engine 2 is a V-type multi-cylinder engine in which a pair of banks (cylinder rows) formed by arranging a plurality of cylinders in the up-down direction are arranged in a V shape, and as illustrated in FIG. 2, includes a V-type six-cylinder engine having three cylinders in each bank. Hereinafter, the right side bank of the engine 2 is referred to as a first bank RB1, and the left side bank is referred to as a second bank LB1.

The engine 2 includes an engine body 2*a* having a first bank RB1 and a second bank LB1, an air intake device 7 provided above the engine body 2*a*, a mount case 8 provided below the engine body 2*a*, and an oil pan 9 provided below the mount case 8.

The engine body 2*a* includes: a crankcase 3 housing the crankshaft 31 extending in the vertical direction; a cylinder block 4 attached to the crankcase 3 and formed with a cylinder 40; a cylinder head 5 attached to the cylinder block 4 and provided with an air inlet port 51 and an air outlet port 52 communicating with the cylinder 40; and a cylinder head cover 6 covering the cylinder head 5. Each of the first and second banks RB1 and LB1 includes the cylinder block 4, the cylinder head 5, and the cylinder head cover 6.

The crankcase 3 and the cylinder block 4 constitute a crank chamber 30, and the crankshaft 31 is housed in the crank chamber 30. The lower end of the crankshaft 31 extends downward from the crank chamber 30 and is connected to the upper end of the drive shaft 20. The upper end of the crankshaft 31 extends upward from the crank chamber 30, and a crank pulley 32 is attached thereto.

In the cylinder block 4, three cylinders 40 arranged in the up-down direction are formed in each of the first bank RB1 and the second bank LB1. Each cylinder 40 slidably houses a piston 41, and one end of a connecting rod 42 is coupled to each piston 41. The other end of the connecting rod 42 is coupled to the crankshaft 31, and the piston 41 slides in the cylinder 40 to rotate the crankshaft 31.

The cylinder head 5 and the cylinder block 4 constitute a combustion chamber 50 for each cylinder 40, and the air inlet port 51 and the air outlet port 52 communicate with each combustion chamber 50. The air inlet port 51 and the air outlet port 52 are provided with an air inlet valve 54 and an air outlet valve 55. A camshaft 53 extending in the vertical direction is rotatably supported on the back side of the cylinder head 5, and the rotation of the camshaft 53 drives the air inlet valve 54 and the air outlet valve 55 to open and close the air inlet port 51 and the air outlet port 52.

A cam pulley 56 is attached to the upper end of the camshaft 53. A timing belt 57 is wound around the cam pulley 56 and the crank pulley 32, and when the crankshaft 31 rotates, the camshaft 53 also rotates via the timing belt 57. The timing belt 57 is also wound around an idle pulley 58 forming a track of the timing belt 57 and a tensioner pulley 59 that applies predetermined tension to the timing belt 57.

The cylinder head cover 6 and the cylinder head 5 include a cam chamber 60 that houses the camshaft 53, and a gas chamber (not illustrated) into which blow-by gas flows via the cylinder block 4, the cylinder head 5, and the like. A breather tube 61 (FIG. 3) communicating with the gas chamber is connected to the cylinder head cover 6, and the blow-by gas flowing into the gas chamber is introduced into the air intake device 7 via the breather tube 61.

The mount case 8 is interposed between the engine body 2*a* and the oil pan 9, and supports the engine body 2*a*. An oil reservoir space formed between the mount case 8 and the oil pan 9 and an internal space of the cylinder head cover 6 communicate with each other via an oil return tube 80, and the oil flowing into the internal space of the cylinder head cover 6 flows into the oil pan 9 (oil reservoir space) via the oil return tube 80.

The oil pan 9 stores oil for lubricating the inside of the engine body 2*a*. The oil stored in the oil pan 9 is pumped up by an oil pump 91, passes through an oil path (not illustrated) formed in the mount case 8, the cylinder block 4, and the cylinder head 5, and is supplied to the bearing portion of the crankshaft 31 and the camshaft 53 and the like.

The air intake device 7 guides the air introduced from an air introduction portion 2*c* formed in the engine cover 2*b* to the air inlet port 51 of the combustion chamber 50 of each of the plurality of cylinders 40 formed in each of the first and second banks RB1 and LB1. The air intake device 7 guides, to the air inlet port 51, and recirculates the blow-by gas introduced from the internal space of the cylinder head cover 6 via the breather tube 61 together with the air.

The air intake device 7 includes an air intake silencer 70, a pair of left and right throttle bodies 71, an intake manifold 72, and a single temperature sensor 73. The air intake silencer 70 includes a silencer body 74 having an exhaust heat unit 75 and a chamber unit 76, a first cover 75*a* covering the exhaust heat unit 75, and a second cover 76*a* covering the chamber unit 76. The first cover 75*a* covers the exhaust heat unit 75 via a seal member 75*b*, thereby forming an exhaust heat space. The second cover 76*a* has a pair of left and right air inlet ports (not illustrated) in the rear part, and covers the chamber unit 76 via a seal member 76*b*, thereby forming an air intake space (air intake passage).

Figure 4:
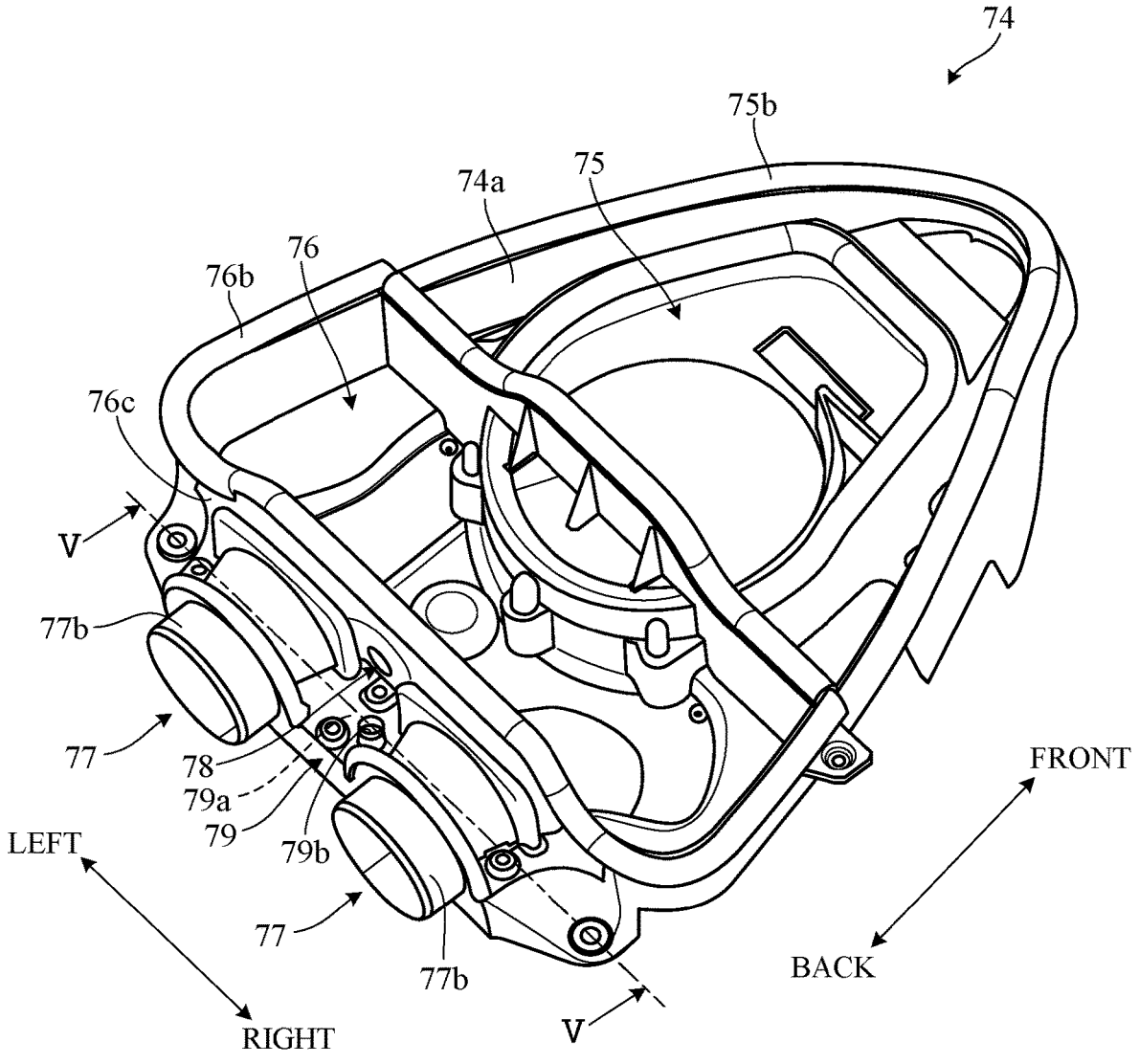
FIG. 4 is a perspective view of a silencer body of an air intake silencer according to the embodiment of the present invention.

FIG. 4 is a perspective view of the silencer body 74 of the air intake silencer 70. As illustrated in FIG. 4, the silencer body 74 is formed in a shape in which the length in the left-right direction gradually increases from the front toward the rear, and constitutes a substantially triangular shape in plan view. The silencer body 74 includes the exhaust heat unit 75 located in front of the air intake silencer 70 and the chamber unit 76 located behind the air intake silencer 70.

The exhaust heat unit 75 is provided with an exhaust fan (not illustrated), and the heat of the engine body 2*a* is introduced into the exhaust heat space via this exhaust fan. The air flowing in from the air introduction portion 2*c* of the engine cover 2*b* is guided to the chamber unit 76 and introduced into the air intake passage. Specifically, the air flowing in from the air introduction portion 2*c* is guided in the vertical direction by a descending flow path (arrow A in FIG. 2), is reversed from the rear to the front (arrow B in FIG. 2) while being branched in the left-right direction by the reverse flow path, and then flows into the air intake passage of the chamber unit 76 via the pair of left and right air inlet ports of the second cover 76*a* (arrow C in FIG. 2).

Figure 5:
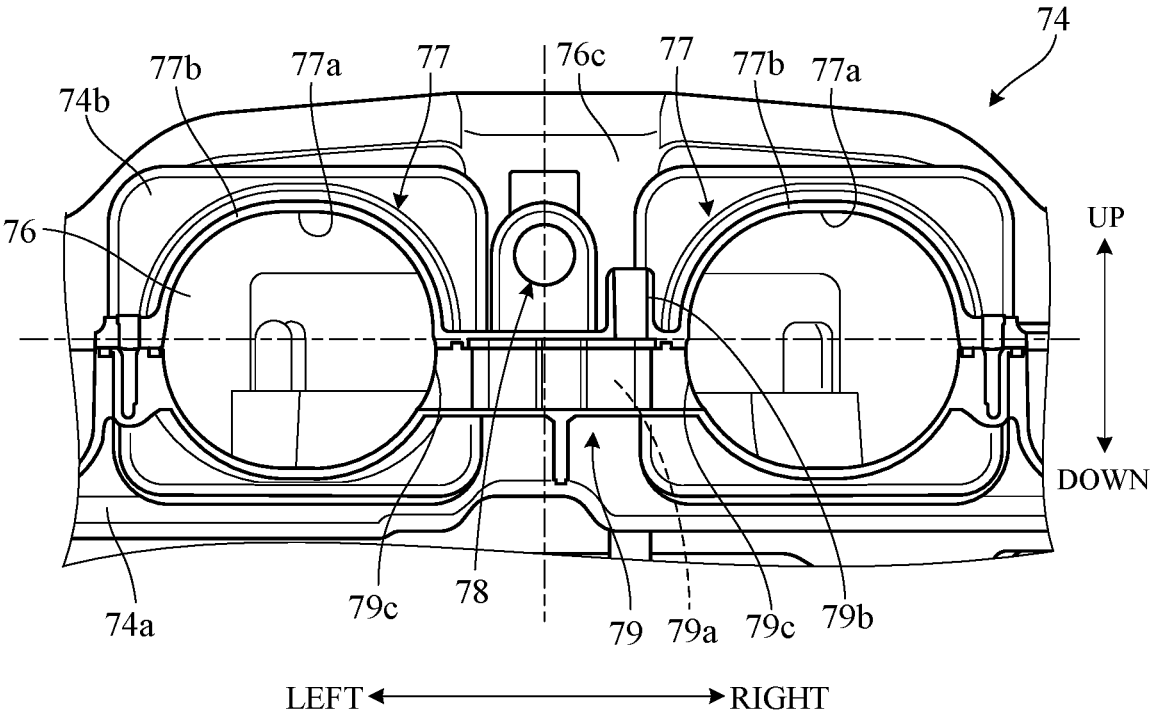
FIG. 5 is a cross-sectional view taken along line V-V of FIG. 4.

FIG. 5 is a cross-sectional view taken along line V-V of FIG. 4. As illustrated in FIG. 5, the chamber unit 76 has a pair of left and right connection portions 77 configured to be able to connect each of the pair of throttle bodies 71 at a rear end part 76*c*. Each of the pair of connection portions 77 includes an opening part 77*a* formed in the rear end part 76*c* and communicating with the air intake passage, and a cylindrical part 77*b* provided to extend rearward from an opening part 77*a* and configured to be able to connect each of the pair of throttle bodies 71. A frame trap 77*c* (FIG. 7) is disposed in the opening part 77*a*, and a grommet 71*b* (FIG. 6) is disposed in the cylindrical part 77*b*.

One end of each of the pair of throttle bodies 71 is connected to each of the pair of left and right cylindrical parts 77*b* formed in the chamber unit 76 via the grommet 71*b*, and the other end is connected to the intake manifold 72. Each of the pair of throttle bodies 71 has a throttle valve 71*a* opened and closed by an actuator (not illustrated), and the amount of intake air sucked into the air inlet port 51 of each of the first and second banks RB1 and LB1 is adjusted by adjusting the opening of the throttle valve 71*a*.

One end of the intake manifold 72 is connected to the other end of each of the pair of throttle bodies 71, and the other end is connected to an air intake pipe communicating with the air inlet port 51 of each of the first and second banks RB1 and LB1. The intake manifold 72 guides the air whose amount of intake is adjusted by the pair of throttle bodies 71 to the air inlet port 51 of each of the first and second banks RB1 and LB1 via the air intake pipe.

An injector is connected to the air intake pipe, and the injector injects gasoline fuel into air whose amount of intake is adjusted by the throttle valve 71*a*. The injected fuel mixes with the sucked air to form an air-fuel mixture, and the air-fuel mixture flows into the combustion chamber 50 when the air inlet port 51 is opened. The air-fuel mixture flowing into the combustion chamber 50 is ignited by an ignition plug and combusted, and the piston 41 is driven to rotate the crankshaft 31. The exhaust gas generated by the combustion is discharged to the outside of the engine 2 through the exhaust pipe when the air outlet port 52 is opened.

The temperature sensor 73 includes a sensor unit 73*a* that detects temperature and a coupler portion 73*b* that fixes the sensor unit 73*a*, and the sensor unit 73*a* detects temperature of air flowing into the pair of throttle bodies 71.

In the case of the V-type engine 2 having the pair of throttle bodies 71 as described above, when only the temperature of the air flowing into one throttle body 71 is detected, there is a possibility that an error occurs between the temperature of the air sent to the air inlet port 51 of each of the first and second banks RB1 and LB1 and the temperature detected by the temperature sensor 73.

Therefore, in the present embodiment, the temperature of the air immediately before flowing into each of the pair of throttle bodies 71, that is, the temperature of the air in the air intake passage is detected between the pair of opening parts 77*a* provided in the chamber unit 76 of the air intake silencer 70. This makes it possible to reduce an error between the temperature of the air sent to the air inlet port 51 of each of the first and second banks RB1 and LB1 and the temperature detected by the temperature sensor 73. In order to satisfactorily achieve such an operation, in the present embodiment, the engine 2 of the outboard motor 1 is configured as follows.

Figure 6:
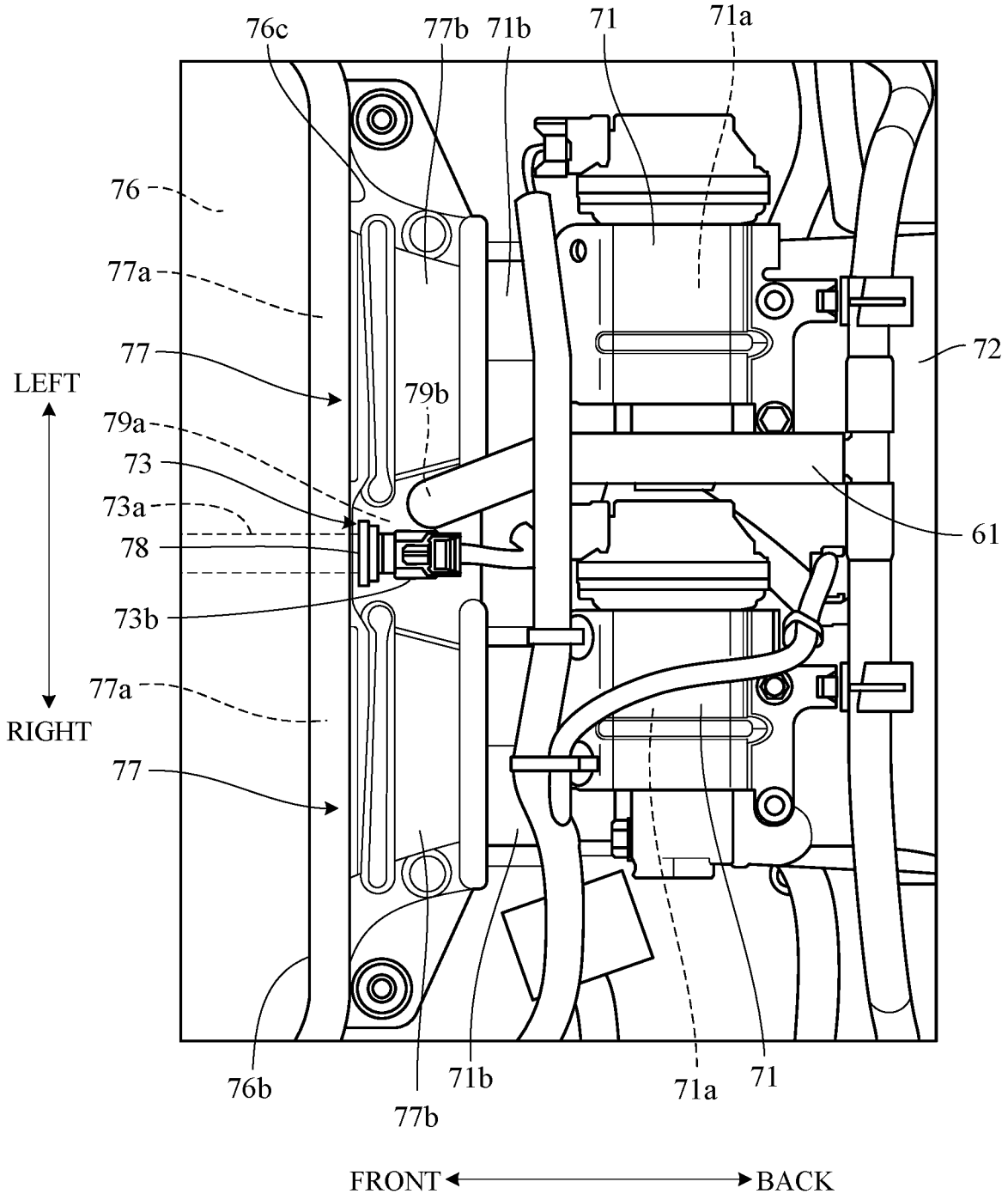
FIG. 6 is an enlarged view of a main component of an air intake device included in the engine according to the embodiment of the present invention.

FIG. 6 is an enlarged view of a main component of the air intake device 7 included in the engine 2 according to the present embodiment. As illustrated in FIG. 6, a sensor attachment portion 78 configured to be able to be attached with the temperature sensor 73 is provided between the pair of opening parts 77*a* formed in the rear end part 76*c* of the chamber unit 76. The sensor attachment portion 78 is provided substantially at the center between the pair of opening parts 77*a* at the rear end part 76*c* of the chamber unit 76 (FIG. 5).

The sensor attachment portion 78 is configured to be able to be attached with the coupler portion 73*b* in a state where the sensor unit 73*a* is inserted from the rear such that the sensor unit 73*a* is positioned in the air intake passage in the chamber unit 76. That is, in a state where the temperature sensor 73 is attached to the sensor attachment portion 78, the sensor unit 73*a* is positioned in the air intake passage in a state of being substantially parallel to the front-rear direction, and the coupler portion 73*b* is positioned in an idle space between the pair of cylindrical parts 77*b*. The idle space here means a space that is not utilized, and in the air intake device 7, the idle space includes a space from between the pair of connection portions 77 connected to the pair of throttle bodies 71 to between the throttle bodies 71.

Figure 7:
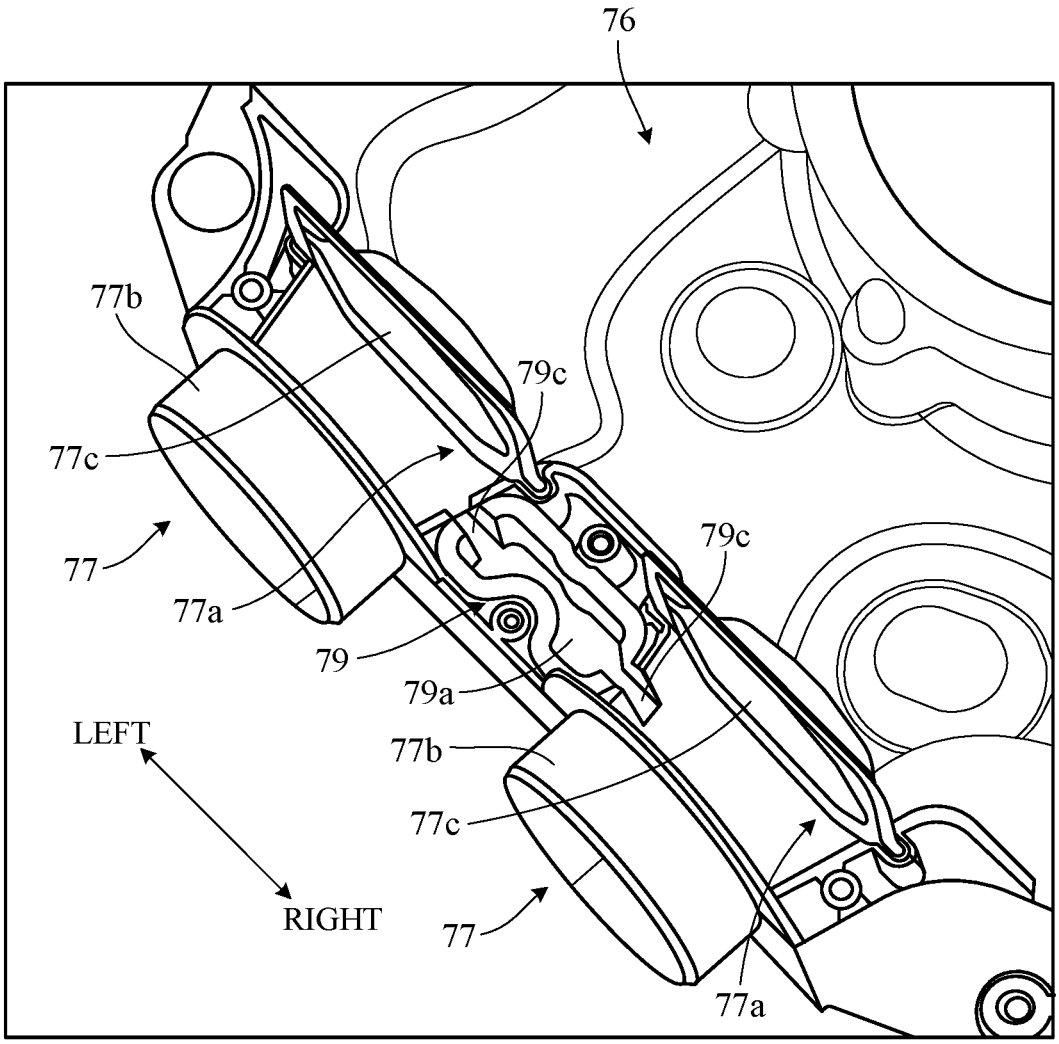
FIG. 7 is a view illustrating a recirculation chamber unit included in the silencer body in FIG. 5.

The chamber unit 76 further includes a recirculation chamber unit 79 that recirculates the blow-by gas from the engine body 2*a* (the gas chamber of the cylinder head cover 6). FIG. 7 is a view illustrating the recirculation chamber unit 79 included in the chamber unit 76 of the silencer body 74 in FIG. 5. FIG. 7 illustrates a state in which a member 74*b* (FIG. 5) constituting a part of the silencer body 74 is removed from the silencer body 74 to expose each of the pair of opening parts 77*a* and the like. The member 74*b* is configured to be fixable to the silencer body 74 with a screw member, a bolt, a nut, or the like.

As illustrated in FIGS. 5 and 7, the recirculation chamber unit 79 is provided between the pair of cylindrical parts 77*b* and below the sensor attachment portion 78. That is, the recirculation chamber unit 79 is also provided in the idle space existing from between the connection portions 77 to between the throttle bodies 71.

The recirculation chamber unit 79 includes a chamber unit body 79*a* into which the blow-by gas flows, a connection portion 79*b* to which the breather tube 61 is connected, and a pair of communication portions 79*c* communicating with the chamber unit body 79*a* and the pair of cylindrical parts 77*b*. The chamber unit body 79*a* is formed in a groove shape in the silencer body 74, and constitutes a recirculation passage by attaching the member 74*b* to the silencer body 74. The shape and size of the chamber unit body 79*a* are not limited thereto, and can be appropriately changed. The connection portion 79*b* is provided in the member 74*b* and communicates the recirculation passage of the chamber unit body 79*a* and the space inside the tube of the breather tube 61. The connection portion 79*b* is provided to protrude upward from the member 74*b*, and is configured to cover the connection portion 79*b* with the tip of the breather tube 61 so that the breather tube 61 is attached. Each of the pair of communication portions 79*c* allows the internal space of each of the pair of cylindrical parts 77*b* to communicate with the recirculation passage of the chamber unit body 79*a*.

Figure 8:
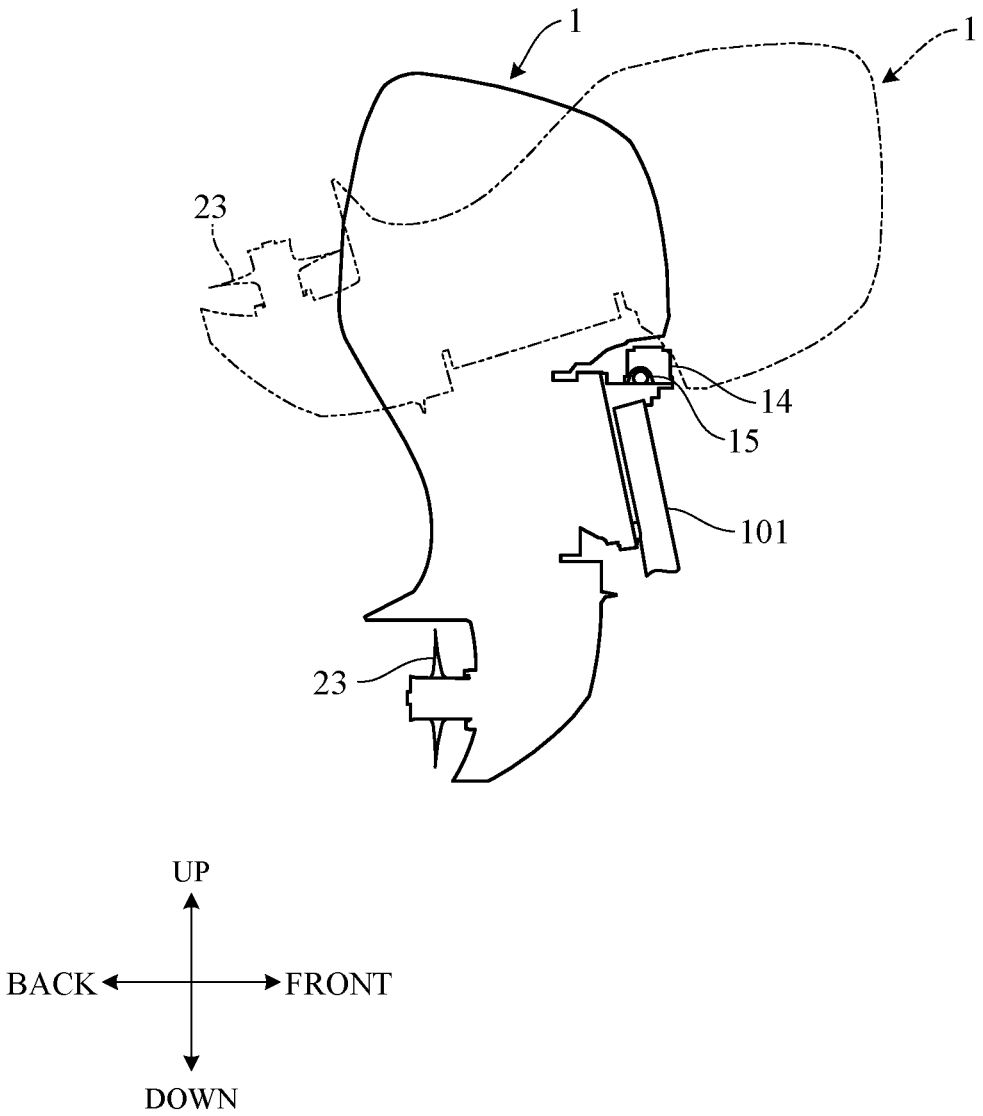
FIG. 8 is a view of the tilted up outboard motor according to the embodiment of the present invention.

FIG. 8 is a view of the outboard motor 1 that is tilted up. As illustrated in FIG. 8, when the outboard motor 1 is tilted up, the engine 2 located above the outboard motor 1 rotates forward with the tilting shaft 15 as a rotation axis. Accordingly, the air intake silencer 70 also rotates forward. Therefore, with the outboard motor 1 tilted up, the front side of the air intake silencer 70 is positioned below and the rear side thereof is positioned above. Due to this, the temperature sensor 73 attached to the rear side of the air intake silencer 70 (the rear end part 76*c* of the chamber unit 76) is held in a state of being positioned above with the outboard motor 1 tilted up. At this time, the sensor unit 73*a* faces downward. Therefore, even when the boat 100 is stored with moisture and oil mixed in the chamber unit 76, the temperature sensor 73 is held above by tilting up, and thus, it is possible to prevent the temperature sensor 73 from being damaged or the like due to moisture, oil, and the like.

The present embodiment can achieve advantageous effects as follows.

(1) The engine 2 is a V-type multi-cylinder engine having the pair of banks RB1 and LB1 (FIGS. 2 and 3). The engine 2 includes the air intake silencer 70 that forms an air intake passage through which air is introduced from the outside, the pair of throttle bodies 71 that adjust an amount of intake air introduced via the air intake passage and sucked into each of the pair of banks RB1 and LB1, and the single temperature sensor 73 that detects temperature of the air in the air intake passage (FIGS. 3 and 6). The air intake silencer 70 has the pair of opening parts 77*a* on the downstream side in the air flow (FIGS. 5 to 7). Each of the pair of throttle bodies 71 is connected to each of the pair of opening parts 77*a* (FIG. 6). The temperature sensor 73 is disposed between the pair of opening parts 77*a* (FIG. 6). This configuration makes it possible to suppress an error between the intake air temperature of each of the banks RB1 and LB1 and the intake air temperature detected by the temperature sensor 73.

If an error occurs between the actual intake air temperature and the intake air temperature detected by the temperature sensor 73, the fuel injection amount cannot be appropriately controlled. That is, the fuel hardly vaporizes when the intake air temperature is low, and easily vaporizes when the intake air temperature is high. Therefore, the fuel injection amount is controlled such that the air-fuel ratio of the air-fuel mixture becomes optimized in consideration of the intake air temperature. When an error occurs between the actual intake air temperature and the intake air temperature detected by the temperature sensor 73, the fuel injection amount cannot be appropriately controlled, fuel consumption deteriorates, and emission purification efficiency deteriorates.

By disposing the temperature sensor 73 between the pair of opening parts 77*a*, it becomes possible to detect the intake air temperature immediately before being distributed to the pair of throttle bodies 71, and it is possible to reduce an error between the intake air temperature of each of the banks RB1 and LB1 and the temperature detected by the temperature sensor 73. This makes it possible to appropriately control the fuel injection amount, and to improve the fuel consumption performance and the emission purification performance of the engine 2.

When each of the pair of temperature sensors is disposed in a flow passage connected to each of the pair of throttle bodies 71, there is a risk that the temperature sensor is positioned near a joint between the air intake silencer 70 and the engine body 2*a*. When the temperature sensor is moved away from such joint, the temperature sensor is also moved away from the throttle body 71, and an error occurs between the actual intake air temperature adjusted by the throttle body 71 and the intake air temperature detected by the temperature sensor, or vibration of the temperature sensor, noise accompanying the vibration, or the like occurs. These problems do not occur in the arrangement of the temperature sensor 73 according to the present embodiment.

(2) The temperature sensor 73 is disposed at a substantially equal distance from each of the pair of opening parts 77*a* (FIG. 6). This configuration makes it possible to further reduce an error between the intake air temperature of each of the banks RB1 and LB1 and the temperature detected by the temperature sensor 73.

(3) The temperature sensor 73 includes the sensor unit 73*a* that detects the temperature of air and the coupler portion 73*b* that holds the sensor unit 73*a* in the air intake passage (FIG. 6). The air intake silencer 70 includes the pair of cylindrical parts 77*b* extending downstream in the flow of air from each of the pair of opening parts 77*a* (FIGS. 4 to 7). The coupler portion 73*b* is fixed to the air intake silencer 70 from the outside between the pair of cylindrical parts 77*b* (FIG. 6). The temperature sensor 73 penetrates the air intake silencer 70 (FIG. 6). This configuration causes the coupler portion 73*b* to be disposed in the idle space between the pair of cylindrical parts 77*b*, and enables the engine 2 to be downsized.

(4) The engine 2 includes the recirculation chamber unit 79 connected to the pair of cylindrical parts 77*b* from between the pair of cylindrical parts 77*b* and recirculates the blow-by gas from the engine body 2*a* to the air intake passage (FIGS. 4 to 7). This configuration causes the recirculation chamber unit 79 and the coupler portion 73*b* to be disposed in the idle space between the pair of cylindrical parts 77*b*, and enables the engine 2 to be downsized.

(5) The outboard motor 1 includes the engine 2 and the propeller 23 that is driven by the engine 2 to rotate (FIGS. 1 and 2). This configuration makes it possible to suppress an error between the intake air temperature of each of the banks RB1 and LB1 and the intake air temperature detected by the temperature sensor 73, to appropriately control the fuel injection amount, and to improve the fuel consumption performance and the emission purification performance, also in the engine 2 of the outboard motor 1.

(6) The outboard motor 1 is attached to the stern of the boat 100 (FIGS. 1 and 2). The pair of opening parts 77*a* are disposed on the bow side of the boat 100 relative to the pair of throttle bodies 71 with the outboard motor 1 tilted down (FIG. 6). The temperature sensor 73 includes the sensor unit 73*a* that detects the temperature of air and the coupler portion 73*b* that holds the sensor unit 73*a* in the air intake passage (FIG. 6). The coupler portion 73*b* is fixed to the air intake silencer 70 from the outside toward the bow side from the stern side of the boat 100 with the outboard motor 1 tilted down (FIG. 6). The temperature sensor 73 penetrates the air intake silencer 70 (FIG. 6). The sensor unit 73*a* extends in the horizontal direction from the coupler portion 73*b* toward the bow side from the stern side of the boat 100 with the outboard motor 1 tilted down (FIG. 6). Since this configuration makes it possible to hold the temperature sensor 73 above when the outboard motor 1 is tilted up, it is possible to suppress the influence of water on the temperature sensor 73.

(7) The outboard motor 1 is attached to the stern of the boat 100 (FIGS. 1 and 2). The pair of opening parts 77*a* are disposed on the bow side of the boat 100 relative to the pair of throttle bodies 71 with the outboard motor 1 tilted down (FIG. 6). The temperature sensor 73 includes the sensor unit 73*a* that detects the temperature of air and the coupler portion 73*b* that holds the sensor unit 73*a* in the air intake passage (FIG. 6). The sensor unit 73*a* extends upward from the coupler portion 73*b* with the outboard motor 1 tilted up (FIGS. 6 and 8). This configuration makes it possible to suppress the influence of water on the temperature sensor 73.

(8) The boat 100 includes the outboard motor 1 and the hull 101 to which the outboard motor 1 is attached (FIG. 1). This configuration makes it possible to suppress an error between the intake air temperature of each of the banks RB1 and LB1 and the intake air temperature detected by the temperature sensor 73, to appropriately control the fuel injection amount, and to improve the fuel consumption performance and the emission purification performance, also in the engine 2 of the outboard motor 1 mounted on the boat 100.

In the above embodiment, the description has been given using the dividable air intake silencer 70 including the silencer body 74, the first cover 75*a* covering the exhaust heat unit 75, and the second cover 76*a* covering the chamber unit 76. However, the air intake silencer may be undividable with the first cover 75*a* and the second cover 76*a* integrally molded with the silencer body 74.

In the above embodiment, the V-type six-cylinder engine has been described, but the present invention is not limited thereto. The present invention is preferably used for a V-type multi-cylinder engine.

The above embodiment can be combined as desired with one or more of the above modifications. The modifications can also be combined with one another.

According to the present invention, it is possible to reduce an error between an intake air temperature of air sucked from the two throttle bodies and a detection temperature that is a detected temperature of the air sucked into the throttle body.

Above, while the present invention has been described with reference to the preferred embodiments thereof, it will be understood, by those skilled in the art, that various changes and modifications may be made thereto without departing from the scope of the appended claims.

What is claimed is:

1. A V-type multi-cylinder engine including a pair of banks, comprising:

an intake member forming an intake passage through which air is guided from outside;

a pair of throttles each configured to regulate an amount of the air sucked into each of the pair of banks through the intake passage;

one single temperature sensor configured to detect a temperature of the air in the intake passage; and a recirculation member configured to recirculate blow-by gas from the engine into the intake passage, wherein the intake member includes:

a pair of openings downstream of the temperature sensor in a flowing direction of the air; and a pair of cylindrical members each extending from each of the pair of openings in the flowing direction of the air, wherein each of the pair of throttles is connected to each of the pair of cylindrical members, wherein the temperature sensor is disposed between the pair of openings, wherein the recirculation member is connected to the pair of cylindrical members from between the pair of cylindrical members.

2. The engine according to claim 1, wherein a distance from one of the pair of openings to the temperature sensor is equal to a distance from the other of the pair of openings to the temperature sensor.

3. The engine according to claim 1, wherein the temperature sensor includes: a detecting member configured to detect the temperature of the air; and a supporting member configured to support the detecting member in the intake passage, wherein the supporting member is fixed to the intake member from outside between the pair of cylindrical members, wherein the temperature sensor penetrates the intake member.

4. The engine according to claim 1, wherein the intake member is configured to be dividable.

5. An outboard motor, comprising:

the engine according to claim 1; and a propeller driven by the engine to rotate.

6. The outboard motor according to claim 5, wherein the outboard motor is mounted on a stern of a boat, wherein the pair of openings are disposed further on a bow side of the boat than the pair of throttles with the outboard motor tilted down, wherein the temperature sensor includes: a detecting member configured to detect the temperature of the air; and a supporting member configured to support the detecting member in the intake passage, wherein the supporting member is fixed to the intake member from outside in a direction from a stern side of the boat to the bow side with the outboard motor tilted down, wherein the temperature sensor penetrates the intake member, wherein the detecting member extends horizontally from the supporting member in the direction from the stern side to the bow side with the outboard motor tilted down.

7. The outboard motor according to claim 5, wherein the outboard motor is mounted on a stern of a boat, wherein the pair of openings are disposed further on a bow side of the boat than the pair of throttles with the outboard motor tilted down, wherein the temperature sensor includes: a detecting member configured to detect the temperature of the air; and a supporting member configured to support the detecting member in the intake passage, wherein the detecting member extends upward from the supporting member with the outboard motor tilted up.

8. A boat, comprising:

the outboard motor according to claim 5; and a hull mounted with the outboard motor.

* * * * *